US011871839B2

(12) United States Patent
Chang

(10) Patent No.: US 11,871,839 B2
(45) Date of Patent: Jan. 16, 2024

(54) RETRACTABLE HAIR BRUSH

(71) Applicant: Humanity Brush LLC, Las Vegas, NV (US)

(72) Inventor: Yi-Shu Chang, Taichung (TW)

(73) Assignee: HUMANITY BRUSH LLC, Las Vegas, NV (US)

( * ) Notice: Subject to any disclaimer, the term of this patent is extended or adjusted under 35 U.S.C. 154(b) by 420 days.

(21) Appl. No.: 17/099,705

(22) Filed: Nov. 16, 2020

(65) Prior Publication Data

US 2022/0151370 A1 May 19, 2022

(51) Int. Cl.

| | |
|---|---|
| ***A46B 7/02*** | (2006.01) |
| ***A46B 9/02*** | (2006.01) |
| ***A46B 5/02*** | (2006.01) |

(52) U.S. Cl.

CPC ..... *A46B 7/023* (2013.01); *A46B 5/021* (2013.01); *A46B 9/023* (2013.01); *A46B 2200/104* (2013.01)

(58) Field of Classification Search

CPC ..... A46B 5/021; A46B 7/023; A46B 9/023; A46B 17/06; A46B 2200/104

USPC ..... 15/160

See application file for complete search history.

(56) References Cited

U.S. PATENT DOCUMENTS

| | | | | |
|---|---|---|---|---|
| 5,862,563 | A | 1/1999 | Hartmann | |
| 6,021,542 | A | 2/2000 | Norman | |
| 7,526,829 | B2 | 5/2009 | Chang et al. | |
| 2007/0017540 | A1* | 1/2007 | Davis | B25G 1/10 132/75.5 |
| 2008/0052854 | A1* | 3/2008 | McKay | A46B 9/08 15/186 |
| 2008/0230082 | A1* | 9/2008 | Malka | A46B 17/06 132/119.1 |

FOREIGN PATENT DOCUMENTS

WO WO2007102160 A1 † 3/2006

* cited by examiner
† cited by third party

*Primary Examiner* — Laura C Guidotti
*Assistant Examiner* — Aaron R McConnell
(74) *Attorney, Agent, or Firm* — Bayramoglu Law Offices LLC

(57) ABSTRACT

A hair brush comprising an upper handle defining a cavity between a front surface and a back surface of the upper handle, a bristle cover positioned into the cavity and facing away from the front surface, wherein the bristle cover comprises a plurality of cavities, a bristle pad, wherein the bristle pad is positioned into the cavity and between the bristle cover and the back surface of the upper handle, a plurality of bristles positioned on the bristle pad, a brush body coupled to the bristle pad, wherein the brush body comprises a mechanical means for moving the plurality of bristles of the bristle pad through the plurality of cavities of the bristle cover.

14 Claims, 5 Drawing Sheets

RETRACTABLE HAIR BRUSH

TECHNICAL FIELD

The present disclosure generally relates to hair brushes and a system of hair brushes for use with various types of human hair or pet hair, and more particularly, to hair brushes having comfort and handling features and retractable bristles for storage, self-cleaning, and protection of brush bristles from damage.

BACKGROUND

Retractable and self-cleaning hair brushes are generally known in the art. Several solutions for cleaning hair brushes have been proposed. For example, a self-cleaning hair brush disclosed in U.S. Pat. No. 6,021,542 includes a plurality of disposable cleaning sheets disposed between bristles of the brush that can be pulled out to remove accumulated hair. This self-cleaning hair brush however requires replacement cleaning sheets which may be hard to find and a costly or burdensome to replace. Other examples of self-cleaning hair brushes are disclosed in U.S. Pat. Nos. 5,862,563 and 7,526,829 both of which include a flexible back surface with or without a spring. The flexible back surface collects the hair, the user then presses downwards to retract brush bristles away from allowing a user to clean the brush back surface. These self-cleaning hair brushes however require a special flexible back surface or spring which lead to greater manufacturing costs and prone to fail over repeated use or under hot conditions. The retractable self-cleaning hair brushes presently available are too heavy, have stiff bristles, or use springs and other mechanisms that are costly to manufacture.

SUMMARY

The disclosed subject matter relates to a hair brush comprising an upper handle defining a cavity between a front surface and a back surface of the upper handle, a bristle cover positioned into the cavity and facing away from the front surface, wherein the bristle cover comprises a plurality of cavities, a bristle pad, wherein the bristle pad is positioned into the cavity and between the bristle cover and the back surface of the upper handle, a plurality of bristles positioned on the bristle pad, a brush body coupled to the bristle pad, wherein the brush body comprises a mechanical means for moving the plurality of bristles of the bristle pad through the plurality of cavities of the bristle cover.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Other features, objectives, and advantages of this application become more apparent by reading detailed descriptions of non-limitative embodiments made with reference to the following accompanying drawings.

DETAILED DESCRIPTION

Other features, objectives, and advantages of this application become more apparent by reading detailed descriptions of non-limitative embodiments made with reference to the following accompanying drawings.

The present disclosure provides a self-cleaning retractable hair brush allowing hair to be easily removed by pulling the brush body of the hair brush away from the handle to retract the bristles into the brush body. Moreover, the retractable hair brush system of the present disclosure provides a light weight hair brush design that is inexpensive to manufacture. The retractable hair brush system provides uses with a hygienic brush that easily releases trapped hair.

Figure 1A:
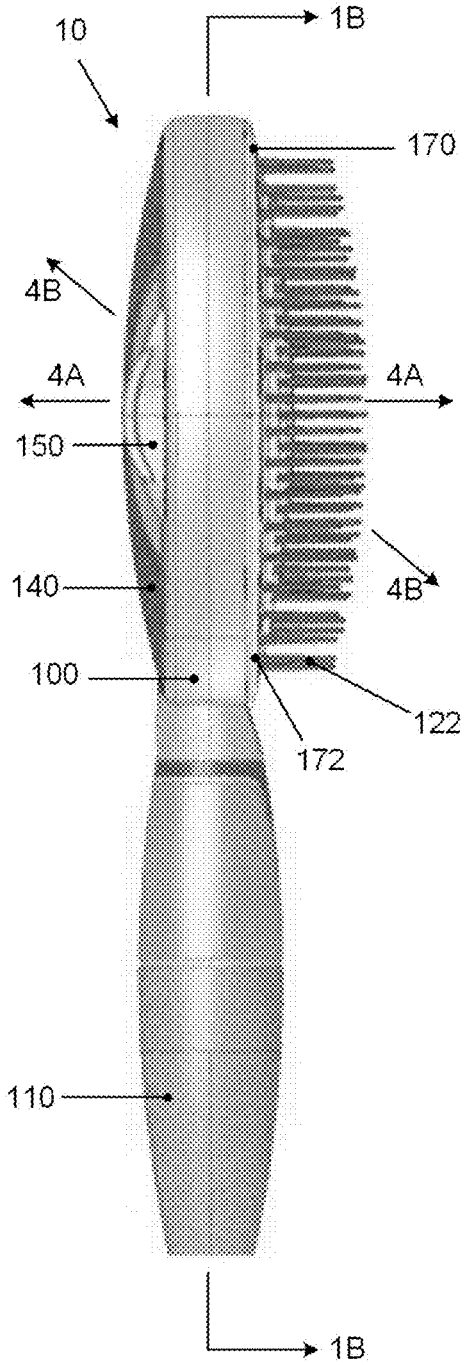
FIG. 1A depicts a right perspective view of an exemplary embodiment of the retractable hairbrush system.
Figure 1B:
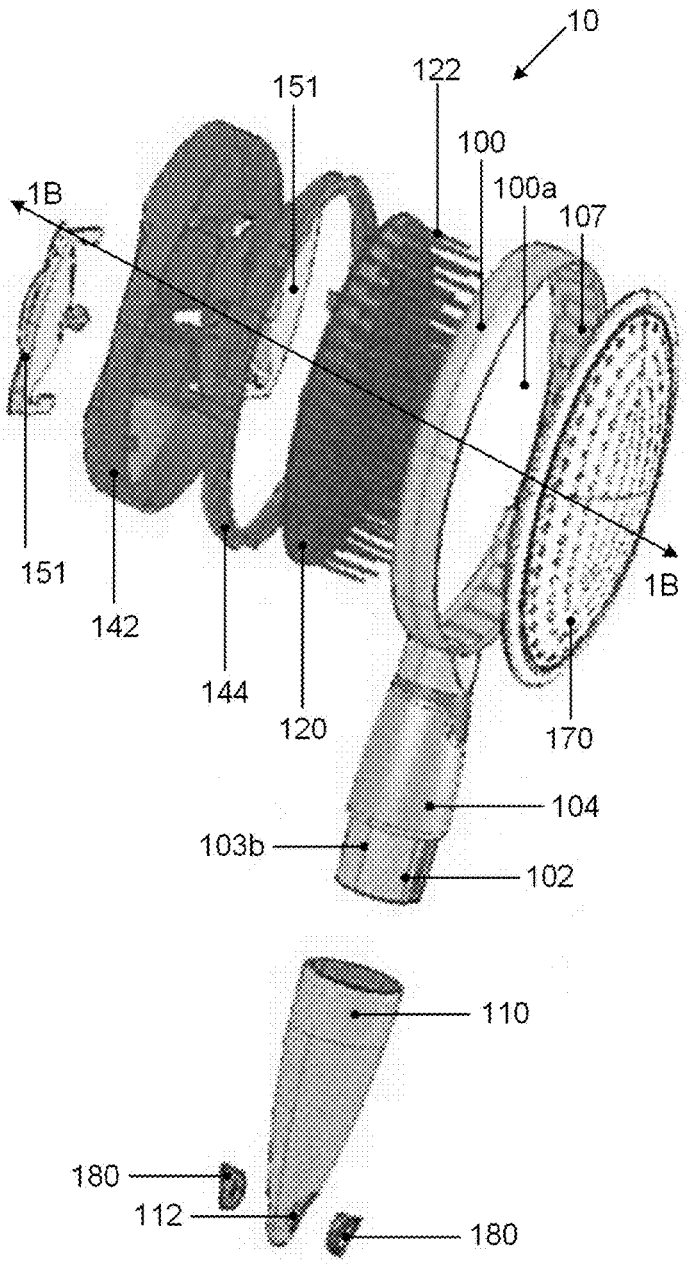
FIG. 1B depicts an exploded view of the retractable hairbrush system taken along line 1B-1B of FIG. 1A.

Referring to FIGS. 1A-1B, an exemplary embodiment of the retractable hairbrush system is disclosed. The exemplary retractable hairbrush system 10 may include upper handle 100, lower handle 110, and bristle cover 170. The bristle cover 170 may detachably slide into the plurality of upper handle grooves 107. The bristle cover 170 covers a top surface of bristle pad 120 and includes plurality of cavities 172 to allow plurality of bristles 122 to retract into and out of the upper handle cavity 100*a*. The plurality of bristles 122 may formed (e.g. by injection molding) together with the bristle pad 120 as one piece, or formed separately as desirable. The bristle pad 120 may be removably coupled to body disk 144 and/or retractable assembly 142. The body disk 144 may be removably coupled to retractable assembly 142 to allow the plurality of bristles 122 to be retracted into and out of cavity 100*a* through movement of the retractable assembly 142. The retractable assembly 142 and body disk 144 may form the brush body 140 of the exemplary retractable hairbrush system 10.

The exemplary retractable hairbrush system 10 may include retractable system 150 coupled to the brush body 140 for extending the plurality of bristles 122 out from the bristle cover 170 upon a push, pinch, press, squeeze, or slight force on the retractable system 150. The plurality of bristles 122 may be retracted back into the cavity 100*a* upon a pull, release, or slide action on the retractable system 150.

One or more surfaces 151 of the retractable system 150 may detachably slide into or couple to the brush body 140 to allow for a better grip and ease in operating the retractable system 150.

The exemplary retractable hairbrush system 10 may further include detachable lower handle 110 and padded or sleeved fabric comfort grip 104 positioned between the lower handle 110 and the upper handle 100. The lower handle 110 may include handle opening 112 with cap covers 180 coupled onto the handle opening 112. The lower handle 110 and upper handle 100 may be hollow to reduce weight and provide ease in handling. The upper handle 100 may include attachment portion 102 with grooves 103*b* for securing the lower handle 110 to the upper handle 100.

The upper handle 100 and lower handle 110 may be fabricated from relatively light weight, durable, and sturdy plastic materials such as polyethylene, polypropylene, polystyrene, or other suitable plastic materials, including but not limited to wood, metal, and composites. Similarly, the upper handle 100 and lower handle 110 may be injection molded, blow molded, continuously molded, extruded, vacuum formed, or the like. The manufacturing process or processes and materials can be selected based on feasibility, cost, tooling concerns, as well as other factors for a given application. The upper handle 100, lower handle 110, plurality of bristles 122, brush body 140, retraction assembly 150, and bristle cover 170 may be manufactured by using, for example, injection molding either individually or simultaneously. For example, the bristle pad 120 and plurality of bristles 122 may be injection molded together in a single process. Alternatively, the plurality of bristles 122 and bristle pad 120 may be molded separately of different materials and assembled together using glue or cement to provide softer bristles 122 and prevent the bristles 122 from being depressed through normal use of the hairbrush.

The bristle pad 120 and/or bristles 122 may be fabricated from relatively resilient and flexible materials such as rubber, fabric, plastic with high pliability, or plastic connected by joints to enable movement, paper-like material such as vellum, mylar, acetate, metal with high pliability in sheets or connected by joints, wooden pieces connected by joints to enable movement, or other suitable flexible material, or any material joined or designed to create flexible movement.

Figure 2A:
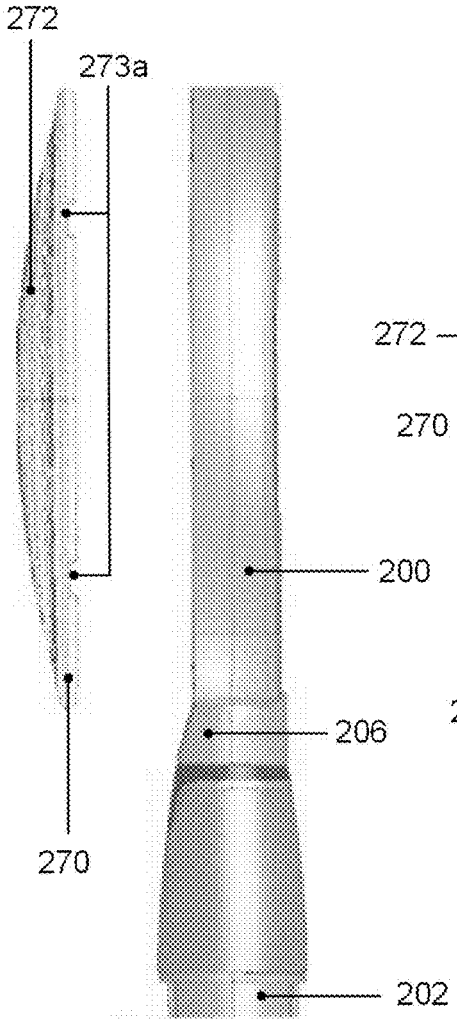
FIGS. 2A-2B depict a left perspective of the top portion of the retractable hairbrush system of FIG. 1B.
Figure 2B:
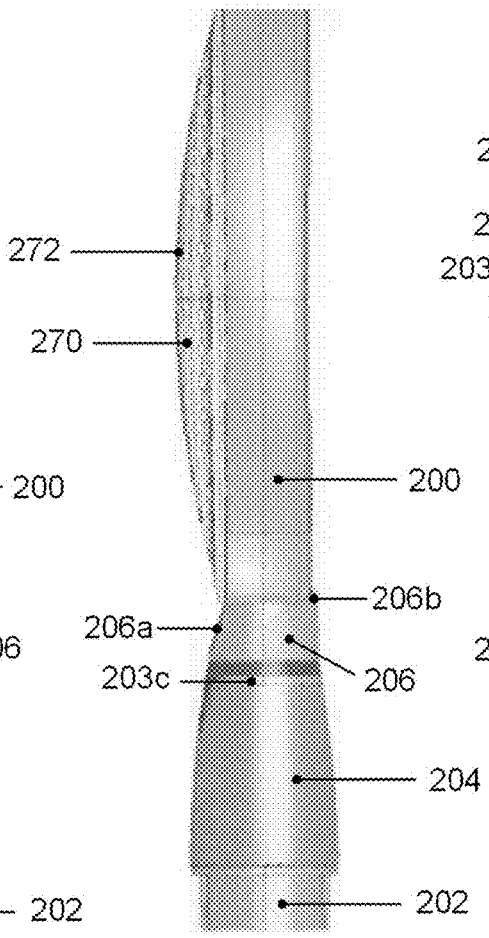
Figure 2C:
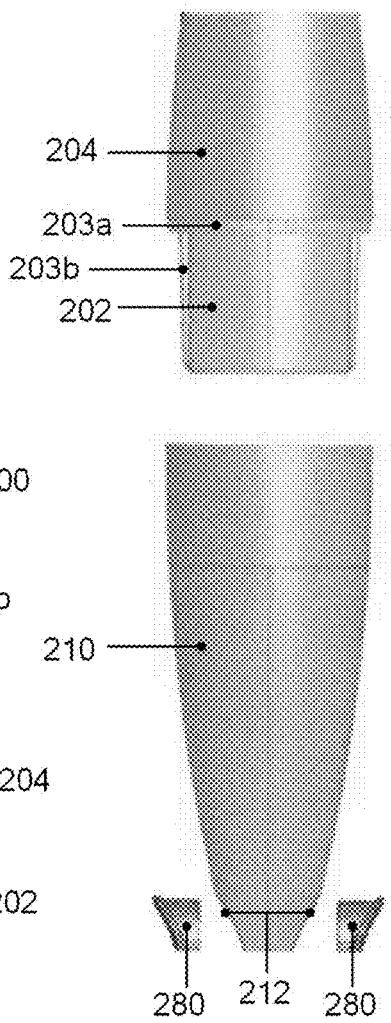
FIG. 2C depicts a left perspective of the bottom portion of the retractable hairbrush system of FIG. 1B.

Referring to FIGS. 2A-2C, an exemplary embodiment of the upper handle 200 is disclosed. The bristle cover 270 may detachably couple onto the front surface of the upper handle 200. The bristle cover 270 may include plurality of cavities 272 for receiving the plurality of bristles 122. The perimeter of the bristle cover 270 lines up along the inner surface of the upper handle 200. The bristle cover 270 may include plurality of cavities 273*a* for attaching to the upper handle 200. The bristle cover 270 may be substantially flat, convex, or concave in shape, and at least a portion of the bristle cover 270 may be received into the inner surface of the upper handle 200 and held in place by an opening, groove, pocket or other cavity or protrusion to grip and hold the perimeter of the bristle cover 270 along the inner surface of the upper handle 200.

The bristle cover 270 may be fabricated from relatively resilient and flexible materials such as rubber, fabric, plastic with high pliability, or plastic connected by joints to enable movement, paper-like material such as vellum, mylar, acetate, metal with high pliability in sheets or connected by joints, wooden pieces connected by joints to enable movement, or other suitable flexible material, or any material joined or designed to create flexible movement.

As shown in FIG. 2B, the upper handle 200 may include neck 206 positioned above the attachment portion 202 and below the bristle cover 270. The neck 206 may include at least one recess 206*a* for reaching underneath the lip of the bristle cover 270 to remove the bristle cover 270 for further cleaning or replacement. Additionally and/or alternatively, the neck 206 may include recess 206*b* on a back surface of the upper handle 200 below the brush body 140 for removing the brush body 140, retractable assembly 150, bristle pad 120 and bristle cover 170 for further cleaning or replacement. The attachment portion 202 may be a substantially hollow cylinder with grooves 203*b* to receive and secure the lower handle 210 to the upper handle 200. Alternatively, the attachment portion 202 may use other attachment means for securing the lower handle 210 to the upper handle 200, for example by using tabs, spacers, or having a slightly larger diameter to firmly secure the lower handle 210 to the upper handle 200.

As shown in FIGS. 2B-2C, the attachment portion 202 may include comfort grip 204 positioned between the upper handle 200 and lower handle 210 to provide a soft flexible grip for holding the retractable hairbrush system 10. The attachment portion 202 may further include one or more covers 203*a* or 203*c* to secure comfort grip 204 in place between the neck 206 and lower handle 210.

As shown in FIG. 2C, the lower handle 210 may include handle opening 212 with cap covers 280 coupled onto the handle opening 212. The handle opening 212 may be used to store or hang the hairbrush 10 in a vertical position.

Figure 3A:
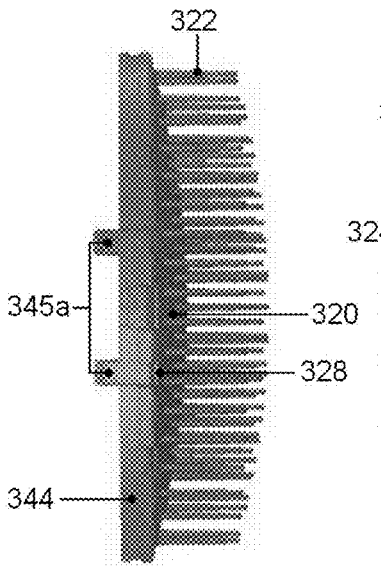
FIG. 3A depicts a left perspective view of an exemplary brush pad of the hairbrush system of FIG. 1B.
Figure 3B:
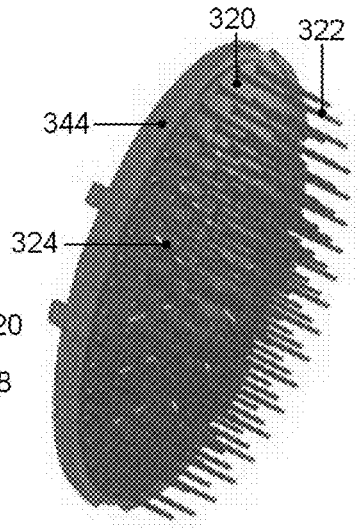
FIGS. 3B-3C depict a front and rear perspective view of the exemplary brush pad of FIG. 3A.
Figure 3C:
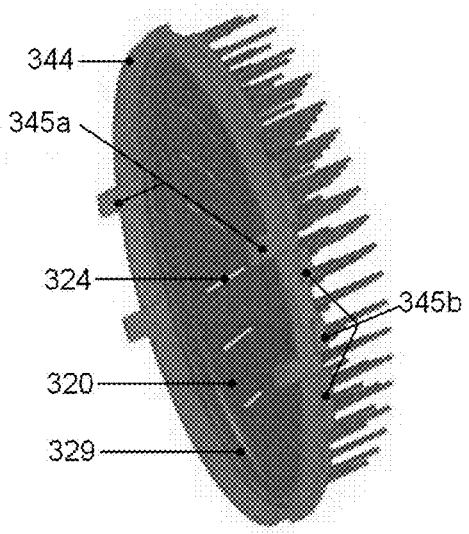

Referring to FIGS. 3A-3C, an exemplary embodiment of the bristle pad 320 is disclosed. In the current exemplary embodiment, the bristle pad 320 and bristles 322 may be made, but not limited to, as a single piece using a single process (e.g. injection molded), however the bristle pad 320 and bristles 322 may be formed separately as desirable of like or differing materials and compositions. The bristle pad 320 includes liner cavity 430 (shown in FIG. 4A) formed between the top perimeter edge lining 328 and bottom perimeter edge lining 329 of the bristle pad 320. The body disk 344 slides into the liner cavity 430 to secure the bristle pad 320 to the body disk 344. The bristle pad 320 includes one or more apertures 324 to provide, for example, greater flexibility of the bristle pad 320 and greater comfort during the hair brushing. Also, the body disk 344 includes tabs 345*a* and indentations 345*b* for snaping to or coupling onto the retractable assembly 142.

Figure 3D:
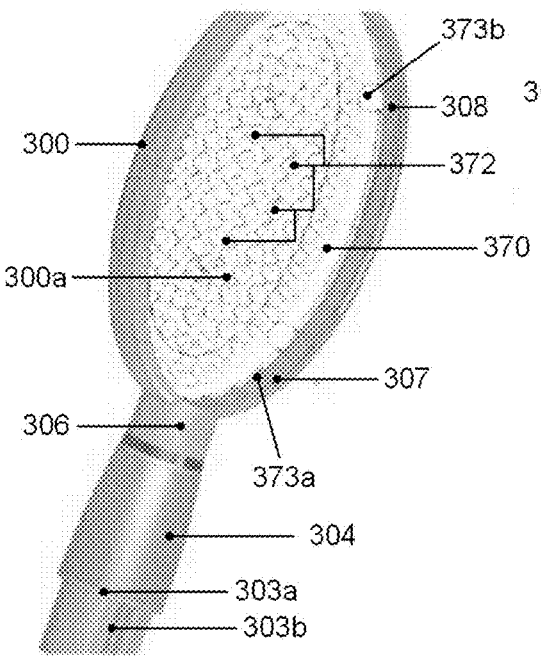
FIG. 3D depicts a rear perspective view of the retractable hairbrush system of FIG. 1B.
Figure 3E:
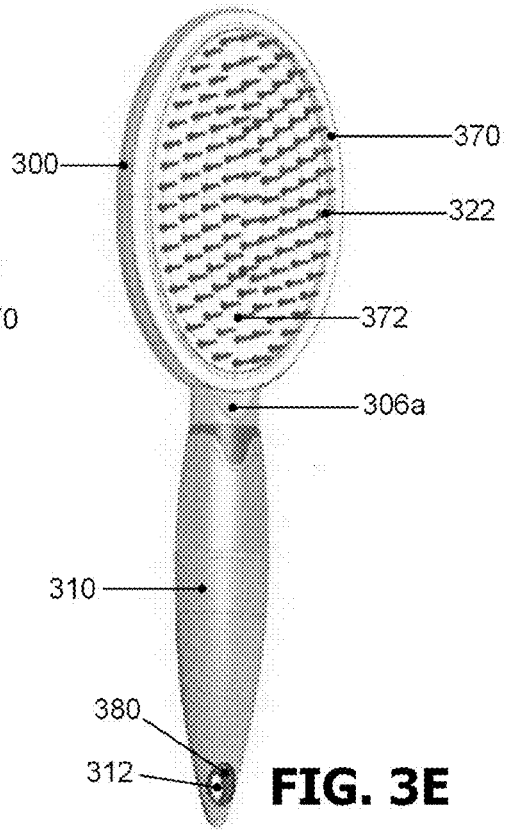
FIG. 3E depicts a front perspective view of the retractable hairbrush system of FIG. 3D.

FIGS. 3D-3E illustrate an exemplary embodiment of bristle cover 370. As shown in FIGS. 2A and 3D, for securing the bristle cover 370 to the upper handle 300, the bristle cover 370 may include plurality of cavities 373*a* (273*a* as shown in FIG. 2A) to slide into grooves 307 of the upper handle 300 and plurality of protrusions 373*b* to slide into the of pockets 308 of the upper handle 300 to receive the of bristle cover 370. As shown in FIG. 3E, as the bristle pad 320 is slid into cavity 300*a* of upper handle 300, bristles 322 slide through and extend out of the plurality of cavities 372. Once coupled to the upper handle 300, the bristle cover 370 may be removed by holding lower handle 310 and using recess 306*a* on neck 306 to reach underneath the lip of the bristle cover 370 to remove the bristle cover 370 from the upper handle 300. The cap covers 380 are shown assembled onto handle opening 312 to allow storing or hanging the hairbrush 10 in a vertical position. One or more grooves 303*b* may be provided to receive and secure the lower handle 310 to the upper handle 300, and one or more covers 303*a* may be provided to secure comfort grip 304 in place between neck 306 and lower handle 310.

Figure 4A:
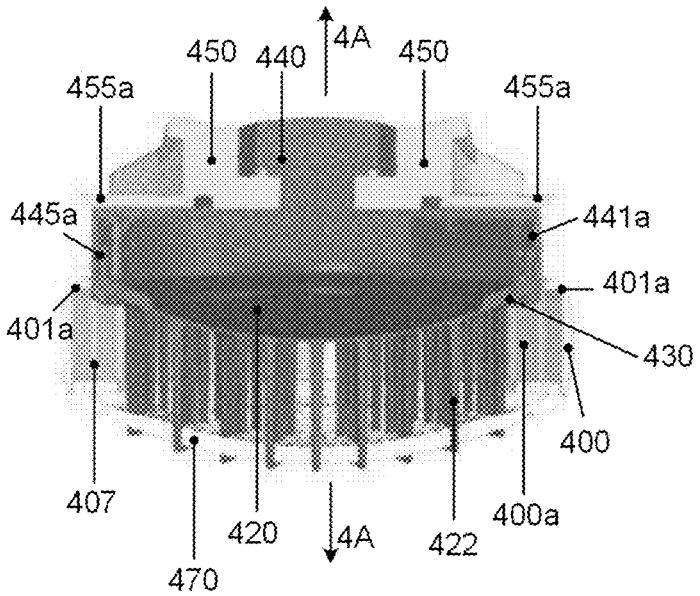
FIG. 4A depicts a sectional view of an exemplary retracting system of the retractable hairbrush system taken along line 4A-4A of FIG. 1A.
Figure 4B:
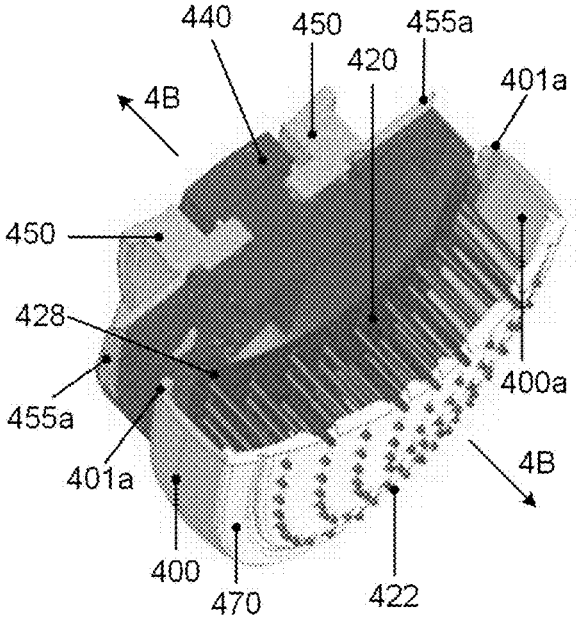
FIG. 4B depicts an angular sectional view of an exemplary retracting system of the retractable hairbrush system taken along line 4B-4B of FIG. 1A.
Figure 4C:
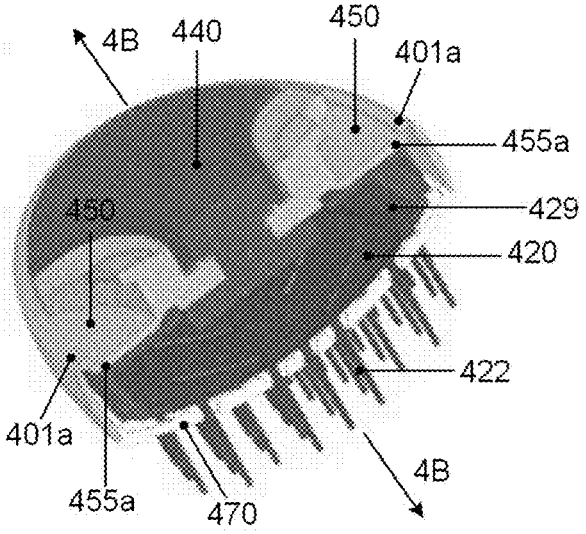
FIG. 4C depicts another angular sectional view of an exemplary retracting system of the retractable hairbrush system taken along line 4B-4B of FIG. 1A.

FIGS. 4A-4C illustrate an exemplary embodiment of the retractable system 450. The retractable system 450 may be formed on the brush body 440 and accessible from the back surface of the upper handle 400. As shown in FIG. 4A, the bristle cover 470 may detachably slide into the plurality of upper handle grooves 407, the bristles 422 and bristle pad 420 detachably couple to the body disk 444. The brush body 440 includes plurality of apertures 441*a* that receive and attach to the tabs 445*a* of the body disk 444. As before, the bristle pad 420 includes a liner cavity 430 formed between the top perimeter edge lining 428 and bottom perimeter edge lining 429 of the bristle pad 420. The body disk 144 slides into the liner cavity 430 to secure the bristle pad 320 to the body disk 144.

As shown in FIGS. 4B and 4C the retractable system 450 may include one or more latches 455*a* positioned at one or more sides of the brush body 440 that secure the brush body 440 within the cavity 400*a* of upper handle 400. The brush body 440 may be moved away from or towards the bristle cover 470 using the retractable system 450. The latches 455*a* may be used to secure the brush body 440 in an extended position as in FIG. 4C by using the latches 455*a* to latch onto the inner lip 401*a* of the upper handle 400. Also, the retractable system 450 may be operated to release the latches 455*a* from the secure position to allow the brush body 440 to be pulled away from the bristle cover 470 as in FIG. 4B.

As shown in FIG. 4B, the latches 455*a* are released from the inner lip 401*a* of the upper handle 400 positioning the bristles 422 and bristle pad 420 in a retracted position. The retractable system 450 may be operated using a pinch, squeeze, press or pull operation to slide, move, or retract latches 455*a* inwards thereby removing the brush body 440 and body disk 444 from the cavity 400*a*.

As shown in FIG. 4C, the bristles 422 and bristle pad 420 are in an extended position. The latches 455*a* extend out and cover inner lip 401*a* of the upper handle 400 to hold the bristles 422 and bristle pad 420 fixed in the extended position. The retractable system 450 may be operated using a pinch, squeeze, press or pull operation to slide, move, or extend latches 455*a* inwards to allow the brush body 440 and body disk 444 to occupy the cavity 400*a* of the upper handle 400.

Figure 5A:
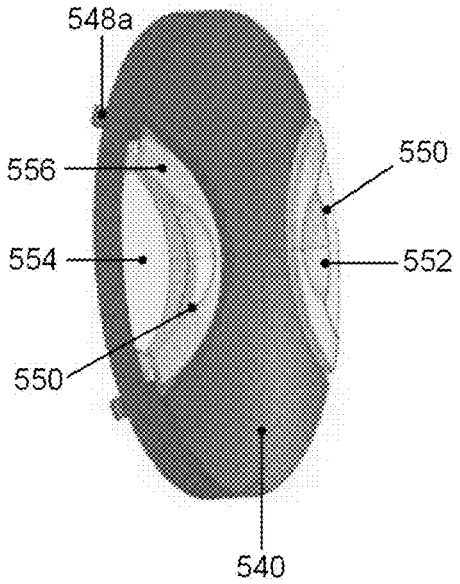
FIG. 5A depicts a front perspective view of the exemplary retracting system of the retractable hairbrush system of FIGS. 4A-4C.
Figure 5B:
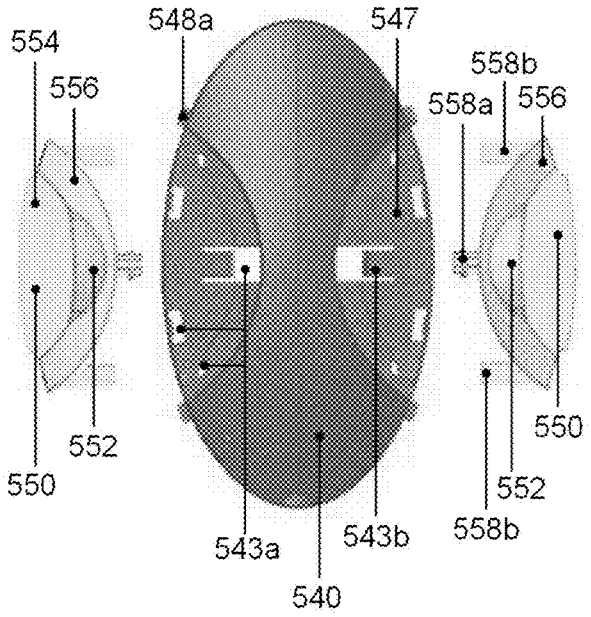
FIG. 5B depicts a front view of the exemplary retracting system of FIG. 5A disassembled to show its components.
Figure 5C:
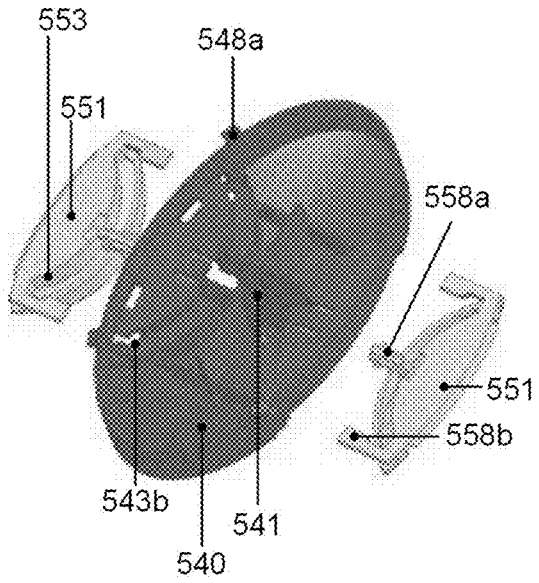
FIG. 5C depicts a rear perspective view of the retracting system of FIG. 5B.

FIGS. 5A-4C illustrate an exemplary embodiment of the brush body 440 and retractable system 550. The brush body 440 may be substantially circular, square, or rectangular in shape and need not be limited to an oval shape as disclosed. As shown in FIGS. 5B-5C, the retractable system 550 fits onto the brush body 440. The brush body 440 attaches to the body disk through tabs 548*a*. The retractable system 550 may comprise at least one button 551 having lower contour surface 554, upper contour surface 556, and recess 552 to allow a user to press onto and operate the retractable system 550 to move or release the latches 555*a*.

As shown in FIG. 5B, the brush body 440 includes a recess 547, tabs 543*b* and openings 543*a* for fitting one or more buttons 551 onto the brush body 440. The tabs 543*b* and openings 543*a* of the brush body 440 couple to the tabs 558*a* and protrusions 558*b* of the button 551. The button 551 is normally under a tensile force from the brush body 440, forcing the buttons 551 and the latches 555*a* to be in a normally extended state. Upon being operated by a user, the buttons 551 receiving a compressive force retracting latches 555*a* away from the perimeter of the brush body 440. As shown in FIG. 5C, the back surface of the brush body 440 includes a plastic vane 541 that provides a tensile force on the tabs 558*a* and protrusions 558*b* of the button 551 to restore the button 551 to a normally extended state as shown in FIGS. 4A-4B.

The body disk 144 may be removably coupled to retractable assembly 142 to allow the plurality of bristles 122 to be retracted into and out of cavity 100*a* through movement of the retractable assembly 142. The retractable assembly 142 and body disk 144 may form the brush body 140 of the exemplary retractable hairbrush system 10.

Apparently, a person skilled in the art can make various modifications and variations to this application without departing from the spirit and scope of this application. In this way, this application is intended to cover these modifications and variations of this application provided that they fall within the scope of protection defined by the following claims of this application and their equivalent technologies.

For a person skilled in the art, apparently, this application is not limited to the details of the foregoing exemplary embodiments and this application can be implemented in other specific forms without departing from the spirit or basic characteristics of this application. Therefore, at any point, the embodiments should be considered to be exemplary and non-restrictive, and the scope of this application is limited by the attached claims rather than the foregoing descriptions, and therefore, all changes falling in the meaning and scope of the equivalent of the claims are included in this application. Any reference numeral of the claims should not be considered as a limitation to the involved claim. In addition, apparently, the term "include" does not exclude other units or steps, and singulars do not exclude plurals. A plurality of units or apparatus described in an apparatus claim may also be implemented by a single unit or apparatus through software or hardware. First, second, and other terms are used to represent names, instead of representing any particular order.

What is claimed:

1. A hair brush comprising:

an upper handle defining a cavity between a front surface and a back surface of the upper handle;

a bristle cover positioned into the cavity and facing away from the front surface, wherein the bristle cover comprises a plurality of cavities;

a bristle pad, wherein the bristle pad is positioned into the cavity and between the bristle cover and the back surface of the upper handle;

a plurality of bristles positioned on the bristle pad; and a brush body coupled to the bristle pad, wherein the brush body comprises a retractable system for movement of the plurality of bristles on the bristle pad through the plurality of cavities of the bristle cover, wherein the brush body includes a vane and the retractable system includes at least one button, the at least one button comprising two protrusions, which are two flat tabs, and a middle tab disposed between the two flat tabs, wherein the vane provides a tensile force on the middle tab and on the two flat tabs when the button is pushed towards the vane, wherein the two flat tabs that are configured such that, for each flat tab of the flat tabs, a surface of the respective flat tab having a largest surface area of the respective flat tab has a surface normal that is parallel to said movement of the plurality of bristles on the bristle pad through the plurality of cavities of the bristle cover.

2. The hair brush of claim 1, further comprising a lower handle coupled to the upper handle.

3. The hair brush of claim 2, wherein the at least one button comprises an upper surface, a lower surface, and a recess formed between the upper surface and lower surface.

4. The hair brush of claim 3, further comprising a body disk, wherein the bristle pad couples to the body disk, and the body disk couples to the at least one button.

5. The hair brush of claim 4, wherein the inside surface of the upper handle comprises a lip, wherein the button comprises a latch, and wherein the latch of the button extends out onto and over the lip to secure the bristle pad in an extended position.

6. The hair brush of claim 5, wherein a bristle pad perimeter comprises a top perimeter lining and a bottom perimeter lining, wherein a liner cavity is formed between the top perimeter lining and the bottom perimeter lining, and wherein the body disk slides into the liner cavity to secure the bristle pad to the body disk.

7. The hair brush of claim 6, wherein the body disk comprises a plurality of tabs extending away from a back surface of the body disk, wherein the brush body comprises an aperture, and wherein the aperture of the brush body secures onto the plurality of tabs of the body disk.

8. The hair brush of claim 7, further comprising a comfort grip positioned between the lower handle and the upper handle.

9. The hair brush of claim 8, wherein the upper handle comprises an attachment portion for fitting onto the lower handle.

10. The hair brush of claim 9, wherein the lower handle and the attachment portion are hollow.

11. The hair brush of claim 10, wherein the upper handle, bristle pad, and bristle cover are substantially oval, square, or rectangular in shape.

12. The hair brush of claim 11, wherein the bristle pad and bristle cover are formed by injection molding.

13. The hair brush of claim 12, wherein the attachment portion includes a recess positioned below the bristle cover to allow access to a side or bottom surface of the bristle cover allowing removal of the bristle cover from the upper handle.

14. The hair brush of claim 13, wherein the bristle pad includes one or more apertures to improve the flexibility of the bristle pad.

* * * * *